US007044558B2

(12) United States Patent
Chiu

(10) Patent No.: US 7,044,558 B2
(45) **Date of Patent: *May 16, 2006**

(54) BALL CHAIR WITH A RETAINING DEVICE

(76) Inventor: Ciber Chiu, No. 54-6, Chipan Lane, Lukang Chen, Changhua Hsien (TW)

( * ) Notice: Subject to any disclaimer, the term of this patent is extended or adjusted under 35 U.S.C. 154(b) by 122 days.

This patent is subject to a terminal disclaimer.

(21) Appl. No.: 10/758,078

(22) Filed: Jan. 16, 2004

(65) Prior Publication Data

US 2004/0245838 A1 Dec. 9, 2004

Related U.S. Application Data

(63) Continuation-in-part of application No. 10/453,625, filed on Jun. 4, 2003, now Pat. No. 6,702,388.

(51) Int. Cl.
*A47C 7/02* (2006.01)

(52) U.S. Cl. ..... 297/452.41; 297/DIG. 3; 297/440.1; 297/217.1; 5/654

(58) Field of Classification Search ..... 297/452.41, 297/217.1, 195.11, DIG. 3, 440.1; 5/654; 482/140 X, 142 X
See application file for complete search history.

(56) References Cited

U.S. PATENT DOCUMENTS 3,635,528 A * 1/1972 Strom ..... 297/452.41
4,126,326 A * 11/1978 Phillips ..... 280/205
5,690,389 A * 11/1997 Ekman et al. ..... 297/452.41
5,833,587 A * 11/1998 Strong et al. ..... 482/123
6,070,943 A * 6/2000 Guery-Strahm ..... 297/452.41
6,146,343 A * 11/2000 Stewart ..... 601/118
6,309,331 B1 * 10/2001 Raymond ..... 482/148
6,461,284 B1 * 10/2002 Francavilla ..... 482/142
6,477,070 B1 * 11/2002 Schweitzer ..... 363/98
6,520,578 B1 * 2/2003 Jospa et al. ..... 297/217.1
D471,371 S * 3/2003 Chiu ..... D6/366
D476,705 S * 7/2003 Dillard ..... D21/662
6,730,005 B1 * 5/2004 Liao ..... 482/142
6,746,372 B1 * 6/2004 Hsu ..... 482/34

FOREIGN PATENT DOCUMENTS

EP 0563820 * 3/1993

* cited by examiner

*Primary Examiner*—Laurie K. Cranmer
(74) *Attorney, Agent, or Firm*—Troxell Law Office, PLLC

(57) ABSTRACT

A ball chair with a retaining device has a seat (10), a spherical cushion (20) and two retaining pieces. The spherical cushion (20) rests on the seat (10). The two retaining pieces are selective retaining rods or retaining walls and are respectively attached to a rear end and a front end of the seat (10). Thus, the spherical cushion (20) is held between the two retaining pieces and firmly secured on the seat (10) to keep the spherical cushion (20) from falling off the ball chair.

8 Claims, 5 Drawing Sheets

BALL CHAIR WITH A RETAINING DEVICE

This is a Continuation In Part application of U.S. application Ser. No. 10/453,625 filed on Jun. 4, 2003 now U.S. Pat. No. 6,702,388

BACKGROUND OF THE INVENTION

1. Field of the Invention

The present invention relates to a ball chair, and more particularly to a ball chair having a retaining device to hold a spherical cushion on a seat in position to enhance the safety of the ball chair.

2. Description of Related Art

A conventional ball chair is composed of a chair and a spherical cushion. The chair has a seat frame with a top face and a partly-spherical passage defined in the top face of the seat frame to receive a lower portion of the spherical cushion inside. By placing the spherical cushion in the partly-spherical passage of the chair, a ball chair is achieved. However, when a user sits on the ball chair, the spherical cushion is deformed forward and falls out of the partly-spherical passage such that the user easily falls from the ball chair. Additionally, when the ball chair is bumped or vibrated, the spherical cushion rebounds and easily springs out of the partly-spherical passage. Therefore, the ball chair is neither safe nor stable for the user.

The present invention has arisen to mitigate or obviate the disadvantages of the conventional ball chair.

SUMMARY OF THE INVENTION

The main objective of the present invention is to provide a ball chair with a retaining device that keeps a spherical cushion from separating from a seat, whereby the ball chair is safe and steady.

Further benefits and advantages of the present invention will become apparent after a careful reading of the detailed description with appropriate reference to the accompanying drawings.

DETAILED DESCRIPTION OF THE PREFERRED EMBODIMENT

Figure 1:
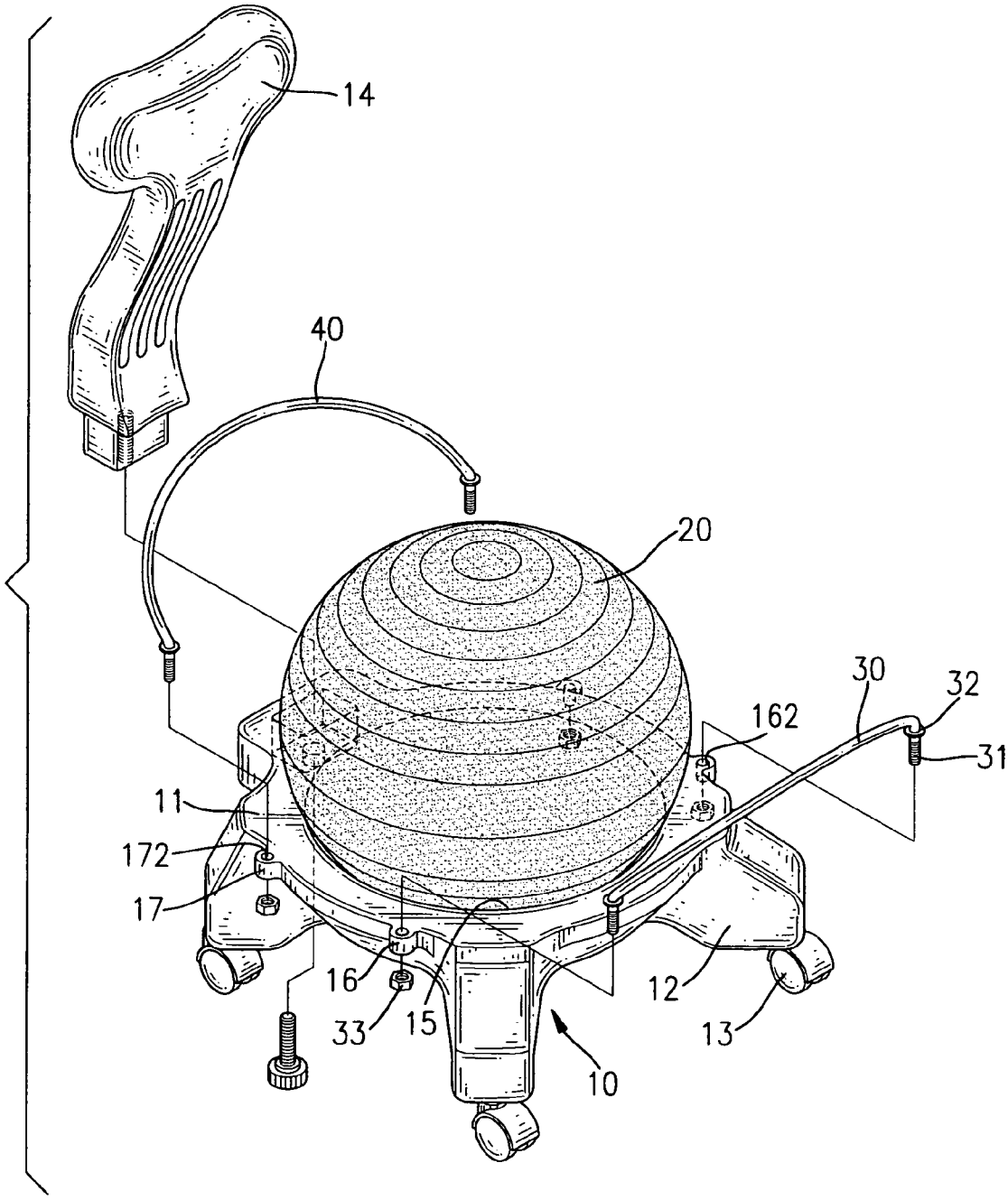
FIG. 1 is an exploded perspective view of a first embodiment of a ball chair with one type of retaining device in accordance with the present invention.

With reference to FIG. 1, a ball chair with a retaining device in accordance with the present invention comprises a seat (10), a spherical cushion (20), a front retaining piece, a rear retaining piece and an optional backrest (14).

The seat (10) has a seat frame (not numbered) with a top face (11), a bottom face (not numbered), a front edge (not numbered), a rear edge (not numbered), multiple legs (12) a dished passage (15), two optional front connecting ears (16) and two optional rear connecting ears (17). The front and rear edges have two sides (not numbered). The multiple legs (12) are attached to the bottom face to support the seat frame, and each leg (12) has a distal end and a wheel (13) attached to the distal end so the ball chair be moved easily. The dished passage (15) extends from the top face (11) to the bottom face and has a larger diameter (not numbered) at the top face (11) and a smaller diameter (not numbered) at the bottom face. The two front connecting ears (16) are formed respectively on opposite sides of the front edge of the seat frame and respectively have through holes (162). The two rear connecting ears (17) are formed respectively on opposite sides of the rear edge of the seat frame and respectively have through holes (172).

The spherical cushion (20) is a resilient bladder and has a diameter slightly larger than the larger diameter of the passage (15). Thus the spherical cushion (20) rests on the seat frame such that a portion of the spherical cushion (20) protrudes through the passage (15).

Any of several types of retaining pieces are selectively attached to the seat frame to hold the spherical cushion (20) on the seat (10). The retaining pieces can be a rod or a backrest (14).

The front retaining piece is attached to the front edge of the seat frame and is a front retaining rod (30) made of rigid material such as plastic, metal, etc. The front retaining rod (30) has a contact rod (not numbered), two end pieces (not numbered) and two nuts (33). The contact rod is preferably curved and abuts the spherical ball (20) at or over the maximum diameter. The two end pieces are parallel to each other and perpendicular to the contact rod. Each end piece comprises a threaded end (31) and a flange (32) formed near the threaded end (31). The threaded ends (31) extend respectively through the through holes (162). The flanges (32) are formed respectively around the end pieces near the threaded ends (31) and abut respectively the front connecting ears (16). To secure the front retaining rod (30) to the front edge of the seat (10), the nut (33) is screwed onto the threaded end (31) to fasten the front retaining rod (30) on the seat (10).

The rear retaining piece may be a rear retaining rod (40) attached to the rear edge of the seat frame in the same manner as the front retaining rod (30). Thereby, the front and rear retaining rods (30, 40) hold the spherical cushion (20) in cooperation with the seat (10) to keep the spherical cushion (20) steady on the seat frame.

Selectively, the rear retaining rod (40) can be replaced by the backrest (14) that is detachably mounted at the rear edge of the seat frame, extends up from the rear edge of the seat frame to support a person's back and abuts the spherical cushion (20) above the maximum diameter. The spherical cushion (20) being held at the maximum diameter by the front retaining rod (30), above the maximum diameter by the backrest (14) and below the maximum diameter by the seat (10) keeps the spherical cushion (20) from falling off the seat (10), even when the ball chair vibrates.

Figure 2:
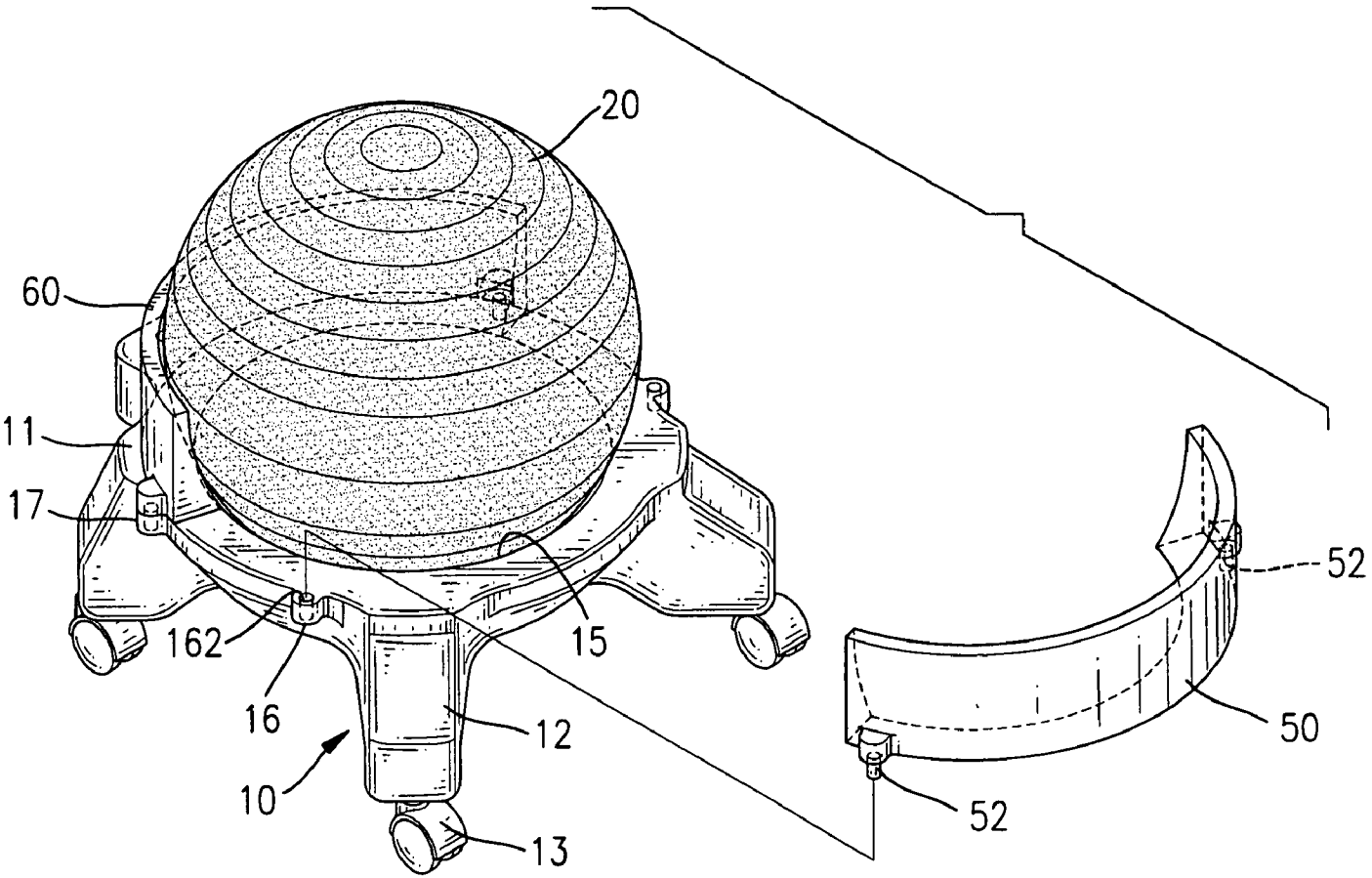
FIG. 2 is an exploded perspective view of a second embodiment of the ball chair with another type of retaining device in accordance with the present invention.
Figure 3:
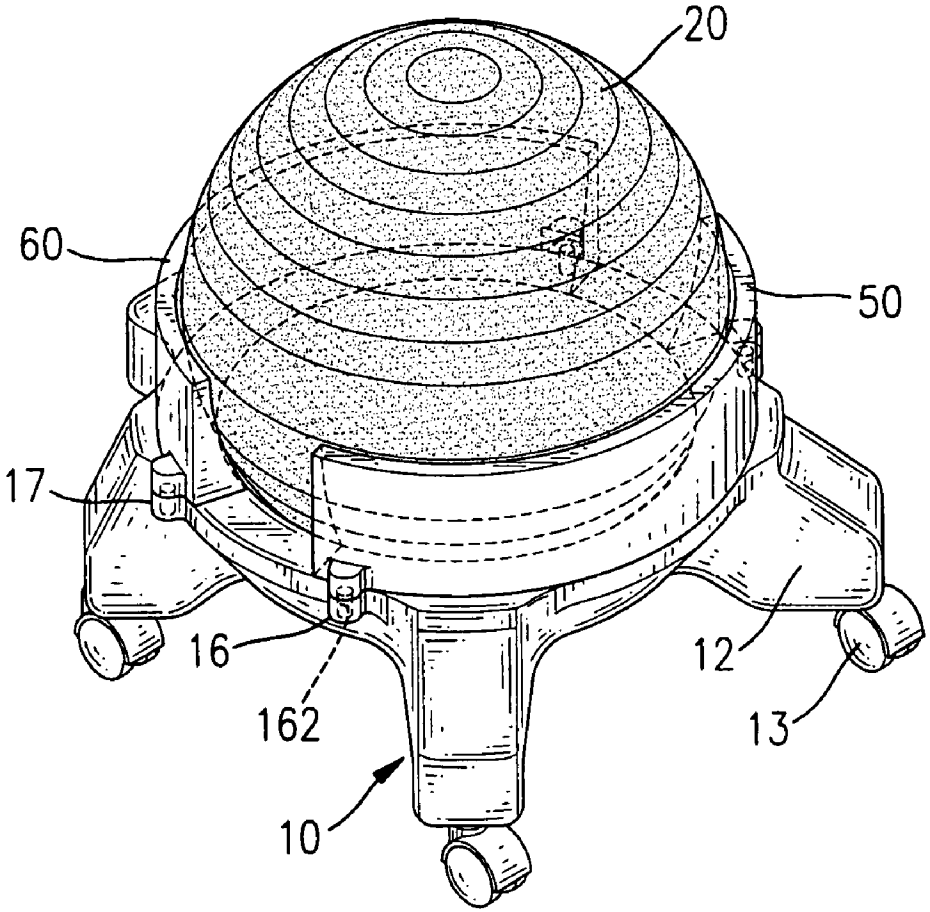
FIG. 3 is a perspective view of the ball chair in FIG. 2.

With reference to FIGS. 2 and 3, two retaining walls (50, 60) may be attached to the seat frame to replace the retaining rods (30, 40). Each retaining wall (50, 60) has a bottom edge (not numbered), a top edge (not numbered), two ends (not numbered), an inner periphery and two stubs (52). The bottom edge is mounted on the top face (11) of the seat frame, and the top edge abuts the maximum diameter of the spherical cushion (20). The two stubs (52) are formed respectively at the two ends of the retaining wall (50) and engage the through holes (162) in the ears (16). The inner periphery of the retaining wall (50) is shaped to correspond to the spherical cushion (20). Thereby, the two retaining walls (50, 60) mounted on the seat frame enclose the spherical cushion (20) in cooperation with the seat (10).

Figure 4:
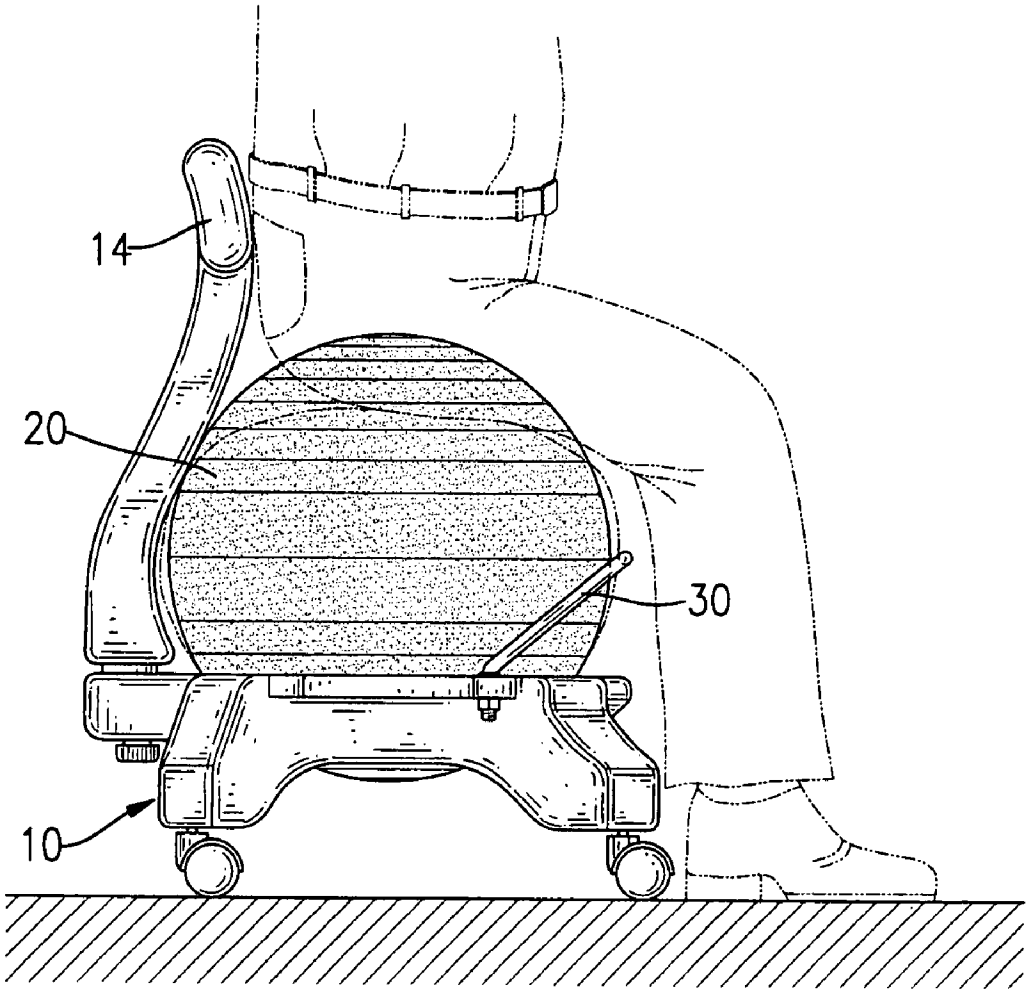
FIG. 4 is an operational side plan view of the ball chair with a backrest and a rod-shaped retaining device in FIG. 1.

With reference to FIG. 4, the spherical cushion (20) is deform and biased to the front edge of the seat (10) when a person sits on one embodiment of the ball chair. The retaining rod (30) and the optional backrest (14) stop the spherical cushion (20) from further deforming and keep the spherical cushion (20) from dislodging from the seat (10), which may otherwise cause the person to fall from the ball chair. Thus, the ball chair is safe and stable.

Figure 5:
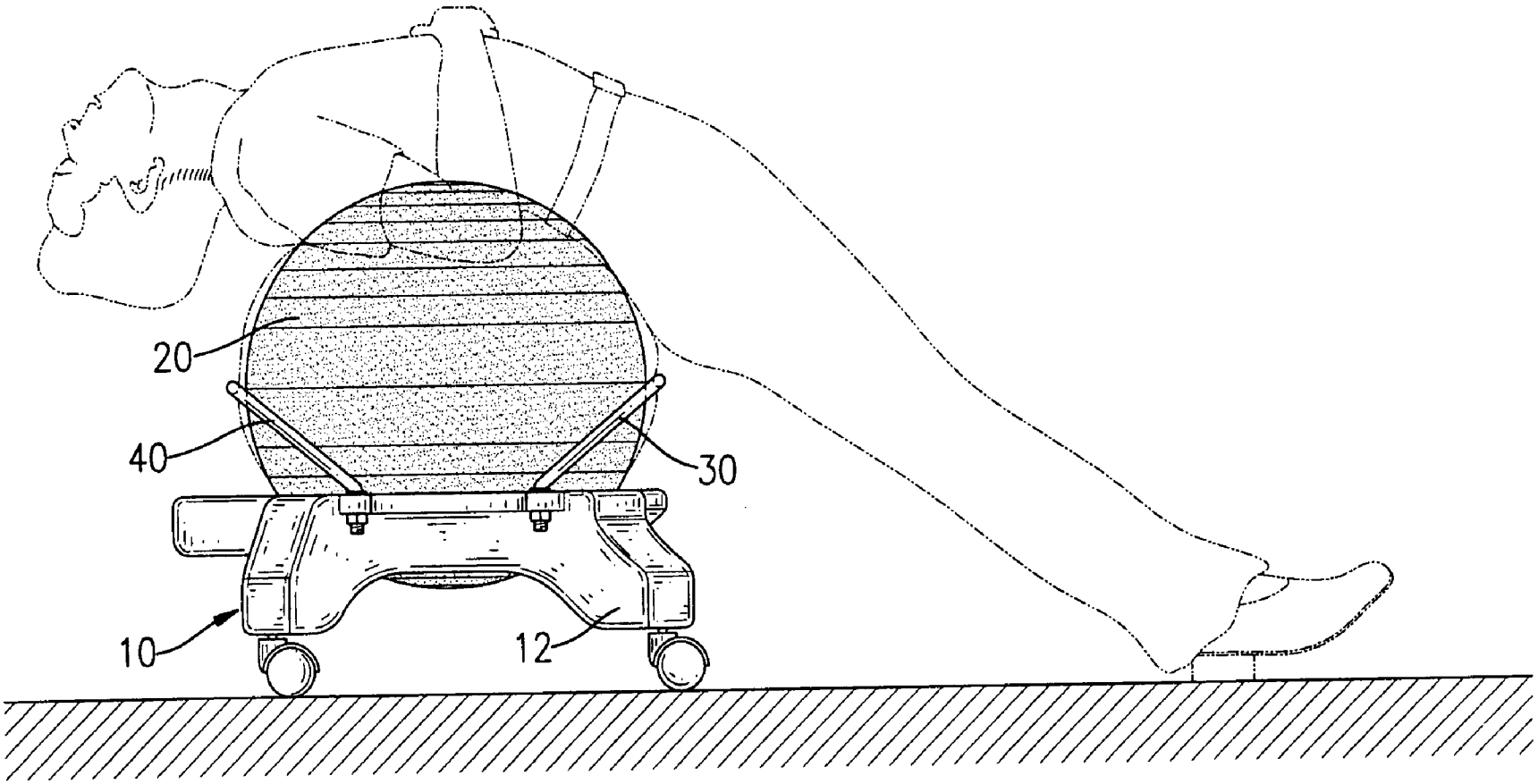
FIG. 5 is an operational side plane view of another embodiment of the ball chair with two rod-shaped retaining devices in FIG. 1.

With reference to FIG. 5, the ball chair is used as an exercise device so a person can lie on the spherical cushion (20) and extend the spine. As an exercise device, the backrest (14) is detached and replaced with a rear retaining rod (40). Additionally, the two retaining walls (50, 60) can optionally replace the two retaining rods (30, 40).

Although the invention has been explained in relation to its preferred embodiment, it is to be understood that many other possible modifications and variations can be made without departing from the spirit and scope of the invention as hereinafter claimed.

What is claimed is:

1. A ball chair with a retaining device comprising:

a seat (10) having a seat frame with a top face (11), a bottom face, a front edge, and a rear edge, multiple legs (12) attached to the bottom face of the seat frame to support the seat frame; and a passage (15) defined in the top face (11) of the seat frame;

a spherical cushion (20) being a resilient bladder, having a diameter and partially received inside the passage (15) to rest on the seat; and two retaining devices mounted respectively on and extending up from the front edge and the rear edge of the seat frame to hold the spherical cushion (20) on the seat frame, wherein the two retaining devices are retaining rods (30, 40), each retaining rod (30, 40) is curved to correspond to the spherical cushion (20).

2. The ball chair with a retaining device as claimed in claim 1, wherein the seat frame further has two front connecting ears (16) formed on two opposite sides of the front edge and each front connecting ear (16) has a through hole (162);

two rear connecting ears (17) formed on two opposite sides of the front edge and each rear connecting ear (17) has a through hole (172);

each end of the two retaining rods (30, 40) is a threaded end (31) to insert into one of through holes (162, 172);

a flange (32) is formed near each respective threaded end (31) to abut one of the connecting ears (16); and a nut (33) is screwed onto each threaded end (31) to fasten the retaining rod (30) on the seat (10).

3. The ball chair with a retaining device as claimed in claim 2, wherein the passage (15) is dished with a larger diameter above a smaller diameter and configured to correspond to the spherical cushion (20); and the spherical cushion (20) has a diameter larger than the larger diameter in the passage whereby the spherical cushion (20) rests on the seat frame.

4. The ball chair with a retaining device as claimed in claim 3, wherein each leg (12) has a distal end and a wheel (13) attached to a corresponding one of the distal ends of the legs (12) to enable the ball chair to be moved easily.

5. A ball chair with a retaining device comprising:

a seat (10) having a seat frame with a top face (11), a bottom face, a front edge, and a rear edge, multiple leas (12) attached to the bottom face of the seat frame to support the seat frame; and a passage (15) defined in the top face (11) of the seat frame;

a spherical cushion (20) being a resilient bladder, having a diameter and partially received inside the passage (15) to rest on the seat; and two retaining devices mounted respectively on and extending up from the front edge and the rear edge of the seat frame to hold the spherical cushion (20) on the seat frame, wherein the two retaining devices are retaining walls (50, 60), and each retaining wall (50) has two ends and is curved to correspond to the spherical cushion (20).

6. The ball chair with a retaining device as claimed in claim 5, wherein the seat frame further has two connecting ears (16) formed on two opposite sides of the front edge and each ear (16) has a through hole (162);

two connecting ears (17) formed on two opposite sides of the rear edge and each ear (17) has a through hole (172);

each end of the two retaining walls (50, 60) has a stub (52) to insert into one of through holes (162, 172).

7. The ball chair with a retaining device as claimed in claim 6, wherein the passage (15) is dished with a larger diameter above a smaller diameter and configured to correspond to the spherical cushion (20); and the spherical cushion (20) has a diameter larger than the larger diameter of the passage whereby the spherical cushion (20) rests on the seat frame.

8. The ball chair with a retaining device as claimed in claim 7, wherein each leg (12) has a distal end and a wheel (13) attached to a corresponding one of the distal ends of the legs (12) to enable the ball chair to be moved easily.

* * * * *